United States Patent [19]

Salomon

[11] 3,988,841

[45] Nov. 2, 1976

[54] SKI-BOOT

[75] Inventor: Georges Pierre Joseph Salomon, Annecy, France

[73] Assignee: S.A. Etablissements Francois Salomon & Fils, Annecy, France

[22] Filed: Aug. 25, 1975

[21] Appl. No.: 607,615

[30] Foreign Application Priority Data

Aug. 30, 1974 France ..... 74.29616

[52] U.S. Cl. ..... 36/117

[51] Int. Cl.[2] ..... A43B 5/04

[58] Field of Search ..... 36/2.5 R, 2.5 AL, 117; 280/11.35 R, 11.35 D, 11.35 K, 11.35 T, 11.35 H, 11.35 Y, 11.35 C

[56] References Cited

UNITED STATES PATENTS 3,801,119 4/1974 Andre ..... 36/2.5 AL 3,869,136 3/1975 Jackson ..... 36/2.5 AL 3,925,911 12/1975 Erlebach ..... 36/2.5 AL

*Primary Examiner*—Patrick D. Lawson

[57] ABSTRACT

The boot is designed to be attached to a ski-boot safety binding and comprises a boot-retaining element located on one of the sides of the ski; one of the ends of the sole of the boot comprises a recess to allow the retaining element to pass under the sole of the boot when the latter pivots; a recess prevents the boot from becoming locked in the binding upon release of the latter when the boot is subjected to a torque of high intensity.

8 Claims, 3 Drawing Figures

SKI-BOOT

The present invention relates to a ski-boot designed to be attached to a ski-boot safety binding comprising one or more retaining elements for the boot located on the sides of the ski and, more particularly, to a ski-boot designed to be attached to a safety-release ski-boot binding comprising two boot-retaining elements located on each side of the ski and extending, at least partly, above the plane of the ski upon which the sole of the boot rests.

Ski-boot safety bindings of this kind are known. German Utility Model 1,851,535, filed on Mar. 17th, 1962, describes a ski binding comprising two safety-release retaining elements located on each side of the ski and holding the boot by its sides.

Bindings of this kind have the advantage of freeing the boot instantaneously when they are released under the action of a longitudinal stress or under the action of a vertical stress. Actually, the most conventional ski bindings, consisting of a front stop and a heel-piece at the rear, have the disadvantage of retaining the boot, even after they are released, either by means of the stop or by means of the heel-piece against which the relevant end of the ski-boot is stopped; this is particularly so when the binding release under the action of a violent longitudinal stress which projects the boot against one or the other of the retaining elements designed to hold it. The result of this may be that the skier breaks a leg, although the binding has released normally.

Obviously a safety binding comprising retaining elements located on each side of the ski has no such disadvantage. On the other hand, it has another disadvantage of the same kind, the consequences of which may be just as serious for the skier, since in this case the boot is no longer totally free to release itself laterally because, even after the release, the retaining elements, which of necessity extend above the plane of the ski, limit lateral travel of the boot. In other words, under the action of an abnormally high torque, even if the safety binding releases normally, the boot will be locked transversely, in relation to the ski, against the retaining elements, and will be unable to pivot freely.

Thus although bindings of this kind cope with incidents arising as a result of a particularly violent longitudinal stress, they do not deal with all of those produced by torque.

It has been suggested that these disadvantages may be overcome by providing the boots with sloping ramps the purpose of which is to allow the sole of the boot to pass over the retaining element while the boot is pivoting, the ramps being generally helicoidal in shape. The result of this is that the skier's boot must inevitably lift in relation to the ski, in order to pass over the lateral retaining elements. It is therefore clear that the boot is completely released from the binding, at least against the skier's weight and generally against the inertia force produced by violent deceleration of the skier at the time of the impact causing the fall. Thus, the provision of sloping ramps, especially helicoidal ramps, on the sole of the boot is not an entirely effective solution, since in order to be fully released, the boot must overcome:

the resilient force of the safety-release system;
the skier's weight;
the force of inertia applied by the skier to the skis;

the frictional forces between the retaining element and the helicoidal ramp on the sole of the boot.

It is an object of this invention to overcome these disadvantages and to allow the boot to release itself from the binding.

This is achieved by providing, under one end of the sole of the boot, preferably the heel, a recess allowing the retaining element to pass under the boot when the boot is released.

With a recess of this kind, the skier's boot is no longer required to lift; after release, therefore, the boot may pivot freely. It will be noted that in order to arrive at this particularly efficient solution, problems relating to the shape of the sole of the boot must be overcome, namely that the sole of a ski-boot, especially the part located under the heel, must be thicker than the remainder of the sole. Thus, the idea of eliminating a substantial portion of the sole of the boot, and producing a boot having an over-hanging heel, is a particularly praiseworthy idea which goes against usage and custom.

According to another characteristic of the invention, the boot is provided with a lateral support when it moves in lateral release. This support may consist of one of the lateral sole-retaining elements. The point at which the boot bears against the retaining element is preferably fixed in relation to the latter, so that the boot pivots about this point of support. But in certain variants of the invention, the movement of the boot in relation to the retaining element may be more complex, being, more particularly, a combination of rotation and translation.

According to still another characteristic of the invention, the profile of the surface defining the recess located under the sole of the boot is defined geometrically by the fact that, for the positions occupied by the boot while it is being released, the maximal width of the sole located between the retaining elements is at all times less than the maximal distance between them.

If the point at which the boot bears against the retaining element is fixed in relation to the latter, the profile of the surface defining the recess should be such that, while the boot is being released, it is inscribed within a circle centred on the point of support of the boot and having a radius at least equal to the distance between the retaining elements in the wide-open position. For all profiles corresponding to this geometrical definition, this ensures that the recess will be large enough to permit the passage of the retaining element opposite that about which the boot pivots.

According to still another characteristic of the present invention, the retaining element passing through the recess cooperates with the boot, at least during a part of the displacement or release thereof, by means of a ramp formed by the surface defining the recess; this ramp may have any kind of profile, as long as it satisfies the preceeding conditions, which are satisfied by the surface defining the recess; it may be neutral, or it may cause decompression or compression of the resilient element actuating the retaining elements.

It is quite clear that the invention relates to the combination of a certain type of safety binding (one designed to retain the boot by its sides) with a ski-boot designed to release itself from the binding in spite of the lateral retaining elements tending to limit its travel.

A non-restrictive description will now be given of an example of embodiment of a binding combined with a boot according to the invention, in conjunction with the drawing attached hereto, wherein.

Figure 1:
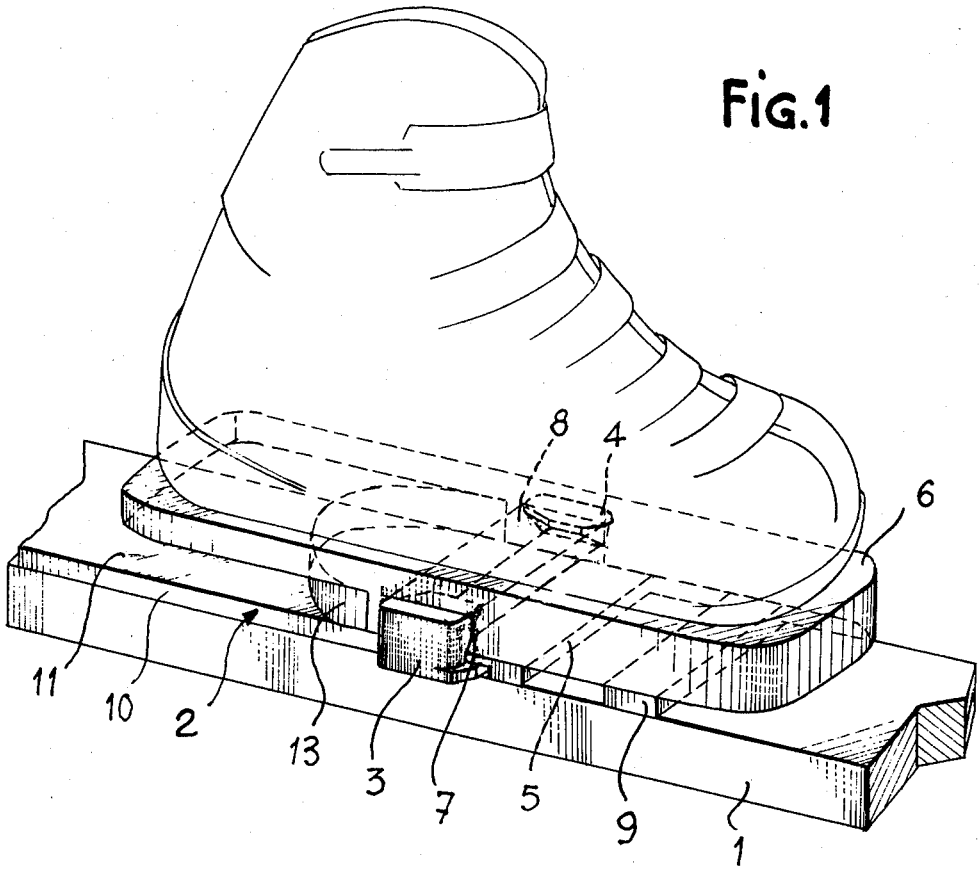
FIG. 1 is a side perspective of a boot according to the invention attached to a binding comprising lateral retaining jaws.

A description will now be given of FIG. 1 which is a perspective of the boot according to the invention, with ski 1 fitted. Attached to ski 1 is a safety binding 2 comprising two lateral jaws providing safety release under the action of a longitudinal stress, a lateral stress, or an abnormally high torque; jaw 4, located on the other side, is shown in dotted lines. These jaws (or retaining elements) 3 and 4 cooperate with the sides of the boot, especially with edge 5 of the sole or of the boot, through two housings 7 and 8 provided for the purpose in the sole of the boot or in a detachable part. In the example illustrated, these housings pass through the sole, but this is obviously not necessary. The housings could equally well be arranged on the jaws, in which case the sole would have projections extending into the jaws.

As already indicated, bindings of this kind have been described, more particularly in German Utility Model 1,851,535 and in French Pat. No. 2,021,237. In the case of the binding described in the latter patent, the sole of the boot is integral with a detachable part cooperating with jaws 3 and 4. It will be seen clearly hereinafter that the present invention is quite compatible with a boot comprising a detachable part of this kind.

Secured to the front of the binding is an anti-friction plate 9 which, on the one hand, serves as a part of the point of support when the boot pivots about its front end under the action of a vertical stress and, on the other hand, limits the frictional forces when the boot pivots laterally or slides longitudinally. The anti-friction plate is made of a material having a low coefficient of friction, such as polytetrafluorethylene.

The mechanisms (resilient systems, levers, and cables), actuating jaws 3 and 4 in known manner, run behind the jaws, the latter being accommodated in a housing 10 which protects them from the weather. The rear of sole 6 of the boot is recessed to height at least equal to the height of the part of the jaws which extends above the horizontal plane upon which the sole of the boot rests. In the case of the variant illustrated in FIG. 1, this recess extends as far as the rear of the boot, the heel being thus in cantilever. Towards the front, recess 11 is defined by a substantially circular profile 13, the geometry of which will be described in greater detail hereinafter, in conjunction with FIG. 3. It will be observed that recess 11 need not be completely under the entire heel of the boot. It need only be wide enough to allow one or the other of the jaws to pass when the boot pivots.

Figure 2:
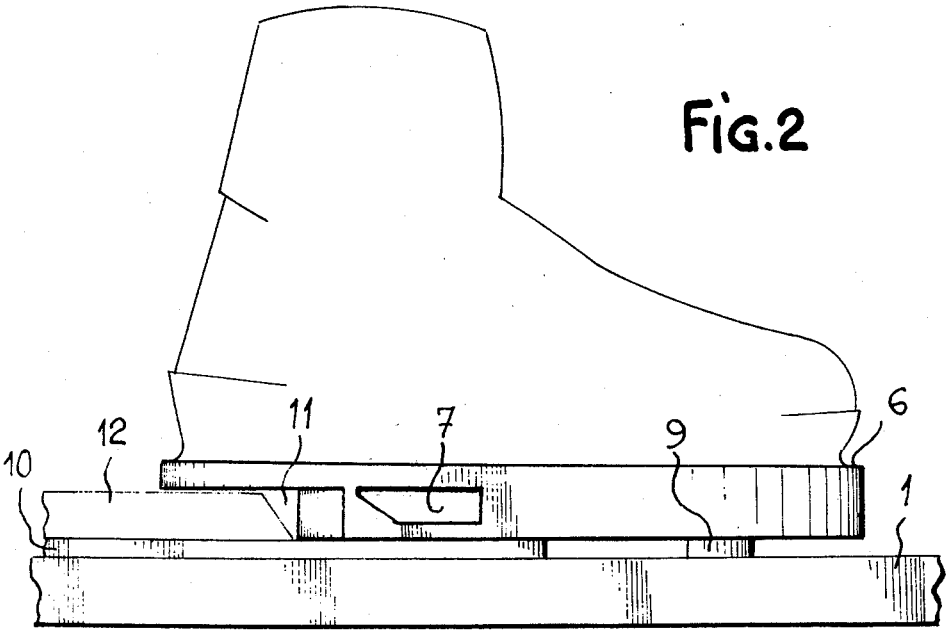
FIG. 2 is a side elevation of the boot illustrated in FIG. 1 (the retaining jaw having been eliminated in order to provide a clear view of the structure of the sole of the boot)

A description will now be given of FIG. 2, which is a side elevation of the boot illustrated in FIG. 1. Most of the parts described above will be recognized, especially ski 1, sole 6 of the boot, recess 11 in the sole running to the rear of the boot, housing 7 designed to cooperate with jaw 3 (not shown in this figure, so that the structure of the sole of the boot may be seen). Also shown in FIG. 2 is an extension 12 to housing 10 of the binding. This extension 12, which extends under the boot into recess 11 in the sole thereof, provides an additional advantage, which may be gathered from the following. It is usually necessary to raise the sole of the boot in relation to the ski, in order to accommodate there under the mechanisms actuating jaws 3 and 4. The additional space available at 11 under the boot may be used to accommodate a part of these mechanisms. As a result of this, the boot according to the invention, comprising a recess 11, has the advantage of being able to be adapted to particularly compact bindings which raise the sole of the boot by only a minimum in relation to the ski.

A description will now be given of FIG. 3 which is a diagrammatic representation of the binding and boot according to the invention, as seen from above after release. Most of the parts described above will be recognized in this figure, especially ski 1, jaws 3 and 4, housing 10 of the binding, and sole 6 of the boot, shown in section through a horizontal plane.

Figure 3:
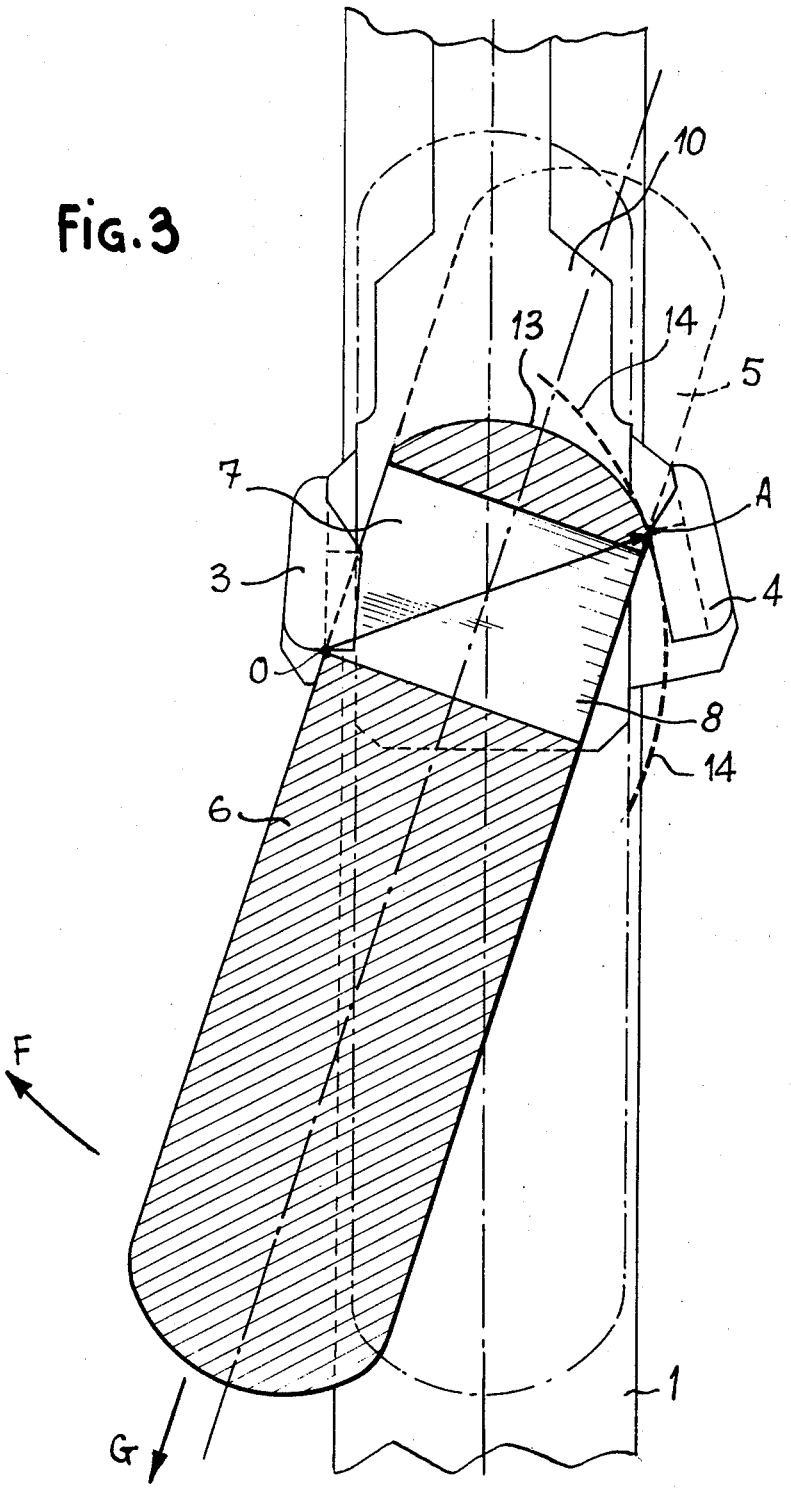
FIG. 3 is a diagrammatic view of the top of the boot and of the binding, after release and during pivoting.

Under the action of a lateral stress, more particularly in the direction of arrow F, the boot pivots and occupies the position shown in FIG. 3 in full lines. During this pivoting, jaw 4 moves away from the boot, being repelled by the latter under the action of the resilient element located within the housing of the binding. When the jaw is completely free of the portion of the boot with which it was engaged, i.e. in the case of this present variation, when jaw 4 is completely free of housing 8 in the sole of the boot with which it is engaged when at rest, the boot may move freely forward in the direction of arrow G. This is precisely the position in which sole 6 of the boot and jaw 4 are shown in FIG. 3, the boot being free to move in the direction of arrow G. However, the skier's leg may still be subjected to a high torque, in which case although the boot may move forward, it will always tend to pivot in the direction of arrow F. Thanks to recess 11 at the rear of the boot, the height and length of which are sufficient to allow jaw 4 to pass, the boot may continue to pivot freely in the direction of arrow F. On the other hand, were no such recess provided, edge 5 of the sole of the boot would come up against retaining element 4 which extends above the plane of the ski; the ski would thus be violently prevented from rotating.

The preferred dimensions of recess 11 will now be given. The boot pivots in the direction of arrow F, bearing at 0 against the outside of jaw 3. In the variant illustrated in FIG. 3, it is the angle formed by the edge of the boot and housing 7 which bears against the jaw, the sole/jaw contact preferably following a vertical line at right angles to the plane of FIG. 3. In order that jaw 4 may pass freely under the heel of the boot, profile 13 defining recess 11 must be inscribed within a circle 14 having a centre 0 and a radius OA equal to the distance between jaw 3 and jaw 4 in the released position. A designer aware of this rule can design a whole series of profiles 13 meeting this requirement. In the variant illustrated in FIG. 3, profile 13 is a circle centred on the longitudinal axis of the boot and is tengential to circle 14 when the boot is in the release position shown in FIG. 3. In the case of curve 13, the wings draw closer, and the resilient element of the locking system is decompressed when the boot continues to turn after it has been released. This rotation may be encouraged by the drawing together of the wings, since jaw 4 then bears against ramp 13. If the friction between the wing and the ramp is low, the sole may in this case be rejected from the binding after the release. It should, however, be remembered that ramp 13 may have any kind of profile, especially a profile which moves the wings apart, or any combination profile. It is also obvious that the invention is not restricted to the example described, in which the boot pivots about one wing, since the movement of the boot in relation to this wing may be more complex and may consist of translation in addition to pivoting, independently of any movement of the wing itself.

Finally, a boot of this kind may be used with bindings other than those described.

What is claimed is:

1. A ski-boot designed to be attached to a ski-boot safety binding comprising at least two safety-release retaining elements for said boot located on each side of the ski and extending, at least partly, above the plane of the ski upon which the sole of the boot rests; said boot being characterized in that the sole of the boot comprises a recess allowing one of the retaining elements to pass when the boot moves and bears against the other retaining element; the profile of the surface defining the recess located under the heel of the boot being defined geometrically by the fact that, for positions occupied by the boot while it is being released, the maximal width of the sole between the retaining elements is at all times less than the maximal distance between them.

2. A boot according to claim 1, said boot being attached to a safety binding such that the point at which the boot bears against the retaining element is fixed in relation to the latter; said boot being characterized in that the profile of the surface defining the recess is defined geometrically by the fact that, for positions occupied by the boot while it is being released, said profile is inscribed within a circle centred on the fixed point at which the boot bears against said other retaining element;

having a radius at the most equal to the distance between the two retaining elements.

3. A boot according to claim 1, comprising a ramp consisting of at least a part of the surface defining the recess, and designed to cooperate with the retaining elements after release.

4. A boot according to claim 3, wherein said ramp cooperating with the retaining elements produces decompression of a resilient element actuating the retaining elements.

5. In combination:

a ski-boot held to the ski by a ski-boot safety binding comprising two safety-release retaining elements for said boot located on each side of the ski and extending, at least partly, above the plane of the sole of the boot; the part of the sole of the boot located under the skier's heel comprising a recess allowing one of the retaining elements to pass under the boot when said boot moves and bears against the other retaining element; the profile of the surface defining the recess located under the heel of the boot being defined geometrically by the fact that, for positions occupied by the boot when it is being released, the maximal width of the sole located between the retaining elements is at all times less than the maximal distance between them.

6. In combination, a safety binding and a ski-boot according to claim 5; the boot bearing laterally against one of the retaining elements at a support point fixed in relation to the latter; the profile of the surface defining the recess being, for all positions occupied by the boot while it is being released, inscribed within a circle centred upon the fixed point of support of the boot on said other retaining element, having a radius at the most equal to the distance between the two retaining elements.

7. In combination, a safety binding and a ski-boot according to claim 5, at least one of the retaining elements cooperating, after release, with a ramp consisting of at least a part of the surface defining the recess in the boot.

8. In combination, a safety binding and a ski-boot according to claim 7, the profile of the ramp cooperating with at least one of the retaining elements producing decompression of a resilient element actuating the retaining element.

* * * * *